US006752523B2

(12) United States Patent
Takahashi

(10) Patent No.: US 6,752,523 B2
(45) Date of Patent: Jun. 22, 2004

(54) VEHICLE LAMP

(75) Inventor: Daisuke Takahashi, Shimizu (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 57 days.

(21) Appl. No.: 10/277,270

(22) Filed: Oct. 22, 2002

(65) Prior Publication Data

US 2003/0076690 A1 Apr. 24, 2003

(30) Foreign Application Priority Data

Oct. 23, 2001 (JP) ..... 2001-324476

(51) Int. Cl.[7] ..... F21V 13/04

(52) U.S. Cl. ..... 362/545; 362/522; 362/245; 362/800

(58) Field of Search ..... 362/545, 522, 362/245, 328, 240, 800, 309, 308, 307, 300, 520, 544, 543, 236

(56) References Cited

U.S. PATENT DOCUMENTS

| | | | | |
|---|---|---|---|---|
| 4,862,330 | A | 8/1989 | Machida et al. | 362/522 |
| 5,678,335 | A | 10/1997 | Gomi et al. | 40/550 |
| 6,038,387 | A | 3/2000 | Machida | 703/2 |
| 6,578,989 | B2 * | 6/2003 | Osumi et al. | 362/298 |

* cited by examiner

*Primary Examiner*—Sandra O'Shea
*Assistant Examiner*—B Q T
(74) *Attorney, Agent, or Firm*—Koda & Androlia

(57) ABSTRACT

A vehicle lamp that uses a special LED made of: translucent block body, an LED chip embedded in the translucent block body, a semi-spherical shape condenser lens provided on the front end surface of the translucent block body and positioned in front of the LED chip, and a reflector provided inside the translucent block body and forwardly reflects the light from the LED chip. The vehicle lamp includes a front lens disposed in front of the special LED so that the front lens is positioned where the direct light from the LED chip and the reflection light reflected by the reflector start to intersect with each other.

9 Claims, 8 Drawing Sheets

VEHICLE LAMP

BACKGROUND OF THE INVENTION

1. Field of the Invention

The present invention relates to a vehicle lamp that uses, as a light source thereof, a special LED or a custom LED which is different from an ordinary LED.

2. Prior Art

A lamp structure that employs LEDs (light emitting diodes) is often adopted for vehicle lamps such as high-mount stop lamps and the like.

In such a vehicle lamp that uses LEDs, as shown in FIG. 8, the light from an LED 112 is subjected to a diffusion deflection control by a plurality of lens elements 114*s* formed on a front lens 114 provided in front of the LED 112. However, since the LED 112 emits only a small amount of light, it is difficult to produce a sufficient amount of illumination light for a vehicle lamp.

More specifically, as seen from FIG. 8, in an ordinary LED 112, of the light radiated from an LED chip 122 that is embedded in a bullet-shaped translucent body 124, the radiation light within a predetermined range of angle with respect to the forward direction of the lamp is used by way of rendering it to be refracted toward the front with the use of a substantially semi-spherical condenser lens 126 that forms the front end portion of the translucent body 124. However, the light radiated at a great radiation angle with respect to the forward direction becomes stray light and therefore cannot be used for illumination. Accordingly, a vehicle lamp that incorporates the LED 112 as described above cannot easily provide a sufficient amount of illumination light The alternative is a method in which, instead of an ordinary LED, a special LED 12 as shown in FIG. 7 is used as a light source of a vehicle lamp.

In this special LED 12, of the light radiated from an LED chip 22 embedded in a translucent block body 24, the radiation light within a predetermined range of angle with respect to the forward direction is used, as in an ordinary LED, by way of rendering it to be refracted toward the front with the use of a condenser lens 26 that is formed to protrude in a substantially semi-spherical shape from the front end surface 24*a* of the translucent block body 24. As to the light radiated at a great radiation angle with respect to the forward direction, such is used also by reflecting the light by a portion of the front end surface 24*a* of the translucent block body 24 that is an area around the condenser lens 26 and then reflecting it by a reflector 28 provided inside the translucent block body 24.

With the use of the special LED 12, the utilization efficiency of the light radiating from the LED chip 22 increases, and as a result, the amount of light emitted increases also. It becomes thus possible to provide a sufficient illumination light intensity required for vehicle lamps.

However, a mere disposing of a front lens in front of the special LED 12 causes problems.

More specifically, in FIG. 7, the direct light B1 passing through the condenser lens 26 does not form a bundle of parallel rays, and it forms a bundle of diffused rays. Accordingly, the direct light B1 starts to intersect with the reflection light B2, which is from the reflector 28, at a position Po that is some distant in front of the special LED 12.

As a result, when the front lens is disposed at a position Pf that is greatly apart from the special LED 12, the front lens has an overlapped incidence area where the overlapped direct light B1 and reflection light B2 are incident. Therefore, in the overlapped incidence area, the direct light B1 and the reflection light B2 are inevitably subjected to the same diffusion deflection control. However, the direct light B1 and the reflection light B2 have different directions of incidence on the front lens, and the direct light B1 has a greater luminous intensity than the reflection light B2. Thus, the problem is that a diffusion deflection control on light from the special LED 12 by means of the front lens cannot be done appropriately.

Conversely, if the front lens is disposed at a position Pn that is closer to the special LED 12, the direct light B1 and the reflection light B2 impinge on the front lens without any intersection, so that the front lens has a no-light impinging area where no light from the special LED 12 is incident. The no-light impinging area appears as a ring-shaped dark area when the lamp is on. Thus, the problem is that the appearance of the lamp is degraded.

SUMMARY OF THE INVENTION

Accordingly, the present invention is to solve the problems described above.

It is an object of the present invention to provide a vehicle lamp that includes a special LED or a custom LED wherein the lamp is capable of appropriately performing diffusion deflection control on the light from the special LED by means of a front lens without degrading the appearance of the lamp.

The present invention achieves the object by contriving the layout of a front lens.

More specifically, the above object is accomplished by a unique structure of the present invention for a vehicle lamp that includes a special LED, which is a light source, and a front lens, which is provided in front of the special LED and performs a diffusion deflection control of light from the special LED by a plurality of lens elements formed on the front lens; and in the present invention, the special LED is comprised of a translucent block body, an LED chip embedded in the translucent block body, a condenser lens protruded in a substantially semi-spherical shape on the front end surface of the translucent block body and positioned in front of the LED chip, and a reflector provided inside the translucent block body so as to forwardly reflect the light originated by the LED chip and reflected by a portion of the front end surface of the translucent block body that is a peripheral area of the condenser lens; and the front lens is disposed near a position where the direct light from the LED chip and passing through the condenser lens and a reflection light reflected by the reflector start to intersect with each other.

The front lens can take any structure in terms of layout and shape of each lens element formed thereon as long as the front lens is designed so that the light from the special LED is subjected to a diffusion deflection control by the lens elements.

Each lens element can be a lens element that merely has a function of diffusing incident light or be a lens element that merely has a function of deflecting the incident light. Furthermore, it can be a lens element that has functions to diffuse and deflect the incident light.

In the vehicle lamp of the present invention, the special LED, which is the light source, is comprised of a translucent block body, an LED chip embedded in the translucent block body, a condenser lens protruded in a substantially semi-spherical shape on the front end surface of the translucent block body and positioned in front of the LED chip, and a reflector provided inside the translucent block body so as to forwardly reflect the light originated by the LED chip and reflected by a portion of the front end surface of the translucent block body that is an area around the condenser lens. Accordingly, the light irradiated from the LED chip in directions within a predetermined range of angle with respect to the front of the LED chip is refracted toward the front by the condenser lens and can be used for illumination, and in addition the light radiating at great radiation angles with respect to the forward direction can be also used as reflection light from the reflector. Accordingly, the use efficiency of the radiation light from the LED chip is improved, and the amount of light emitted is increased. Consequently, the lamp sufficiently provides an amount of illumination light required for a vehicle.

In the vehicle lamp of the present invention, the light from the special LED is subjected to a diffusion deflection control by a plurality of lens elements of the front lens provided in front of the special LED. Since the front lens is disposed near the position where the direct light passing through the condenser lens and the reflection light from the reflector start to intersect with each other, the lamp has various advantages.

Though the direct light and the reflection light differ from each other in the direction of incidence and the intensity, since the front lens is disposed near the position at which the direct light and the reflection light start to intersect with each other, the formation of an overlapped incidence area in the front lens where the overlapped direct and reflection lights is incident is avoided. Thus, it is possible to appropriately perform the diffusion deflection control on the light from the special LED by means of the front lens.

Furthermore, since the front lens is disposed near the position where the direct light and the reflection light start to intersect with each other, the formation of a ring-shaped no-light impinging area in the front lens where no light from the special LED is incident is prevented. Thus, the front lens appears bright over the entire surface when the lamp is on, and appearance degradation of the lamp is prevented.

As seen from the above, according to the present invention, a vehicle lamp that includes a special LED appropriately performs a diffusion deflection control on the light that is from the special LED by means of the front lens without causing any degradation in the appearance of the lamp.

In the meantime, as described above, the direct light passing through the condenser lens has a higher light intensity than the reflection light from the reflector. Therefore, if, of the plurality of lens elements that form the front lens, a lens element positioned in a direct light impinging area where the direct light impinges has a diffusion angle that is set at a value which is greater than a diffusion angle of a lens element positioned in a reflection light impinging area where the reflection light impinges, then the entire front lens appears substantially uniformly bright when the lamp is on. The appearance of the lamp is thus enhanced.

Meanwhile, the borderline between the direct light impinging area and the reflection light impinging area appears in a substantially circular shape on the front lens. Accordingly, if a plurality of lens elements are disposed in a grid pattern, some of the lens elements are positioned on the borderline between the direct light impinging area and the reflection light impinging area. In such a structure, by way of setting the diffusion angle of each lens element positioned on the border line at a diffusion angle that is set for the lens element of the two areas that correspond to one of the direct light and the reflection light that impinges in a greater amount, it becomes possible to perform a sufficiently appropriate diffusion deflection control.

The vehicle lamp of the present invention uses either a single special LED or a plurality of special LEDs as a light source.

When a plurality of special LEDs are employed, they are disposed so as to have an aligned irradiation direction. In this structure that uses a plurality of special LEDs, the front lens includes a plurality of lens elements that perform, for each one of the special LEDs, the diffusion deflection control on the light from the special LEDs. Thus, the front lens appears bright for a broad luminescent area.

Furthermore, it can be designed so that a plurality of special LEDs are disposed in a row and each special LED has a substantially rectangular shape that is elongated in the direction of the row or linear arrangement of the LEDs. With this structure, a thin-type lamp structure suitable for a high-mount stop lamp or the like can easily be produced.

DETAILED DESCRIPTION OF THE INVENTION

Figure 1:
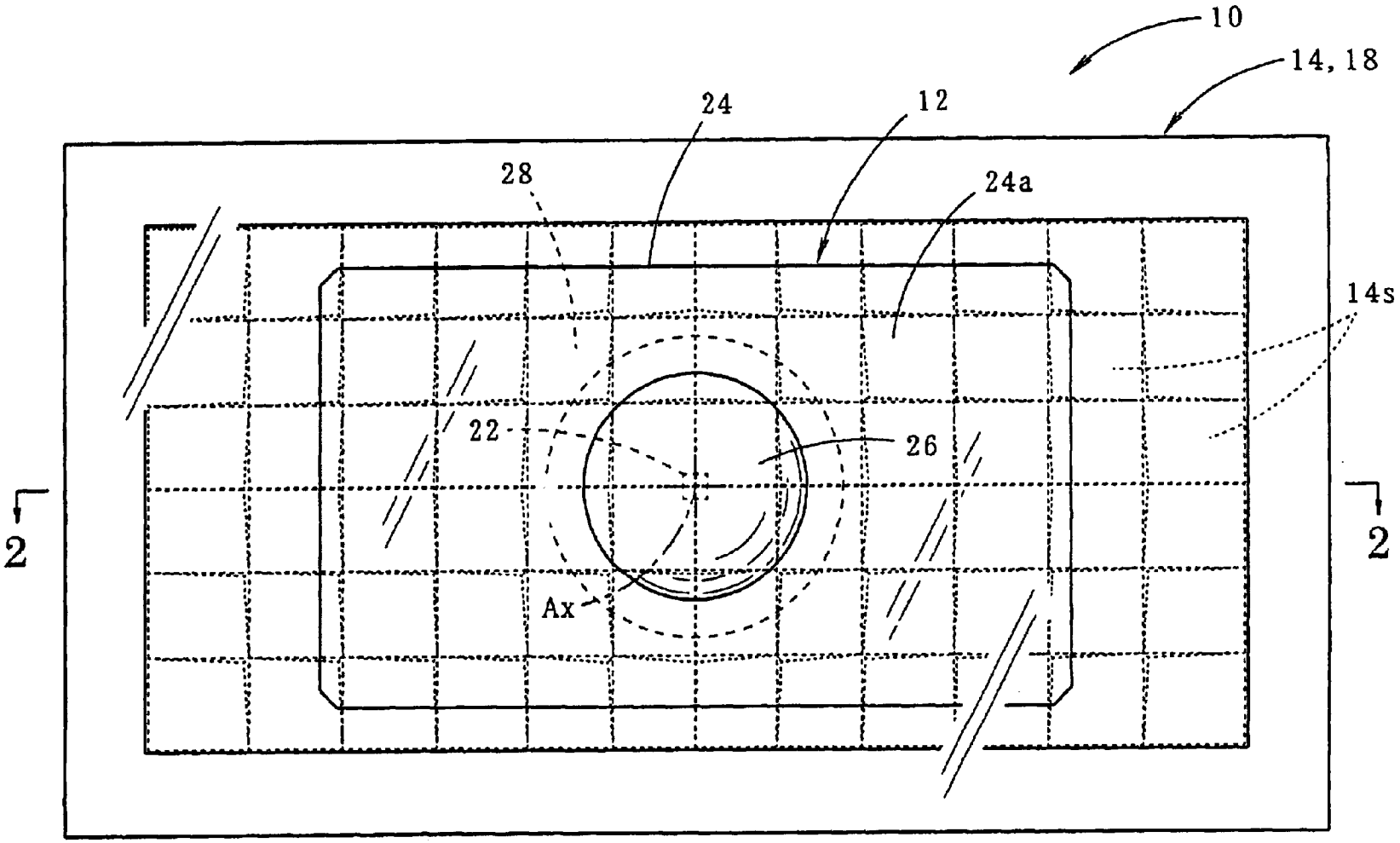
FIG. 1 is a front view of a vehicle lamp according to one embodiment of the present invention.

Embodiments of the vehicle lamp according to the present invention will be described below in detail with reference to the accompanying drawings.

As seen from FIGS. 1 through 4, the vehicle lamp 10 in the shown embodiment is a small-size lamp unit. A plural number of vehicle lamps 10 can be arrange, for instance, side by side so that they make a marker lamp such as a tail lamp, a stop lamp, etc.

The vehicle lamp 10 includes a special LED 12 as a light source, a front lens 14 that is disposed in front of the special LED 12 and performs diffusion deflection control of the light from the special LED 12 by means of lens elements 14*s* formed thereon, a printed circuit board 16 supporting the special LED 12 thereon, and a lamp body 18 that contains the printed circuit board 16 and the special LED 12 and supports at a front end surface thereof the front lens 14.

Figure 2:
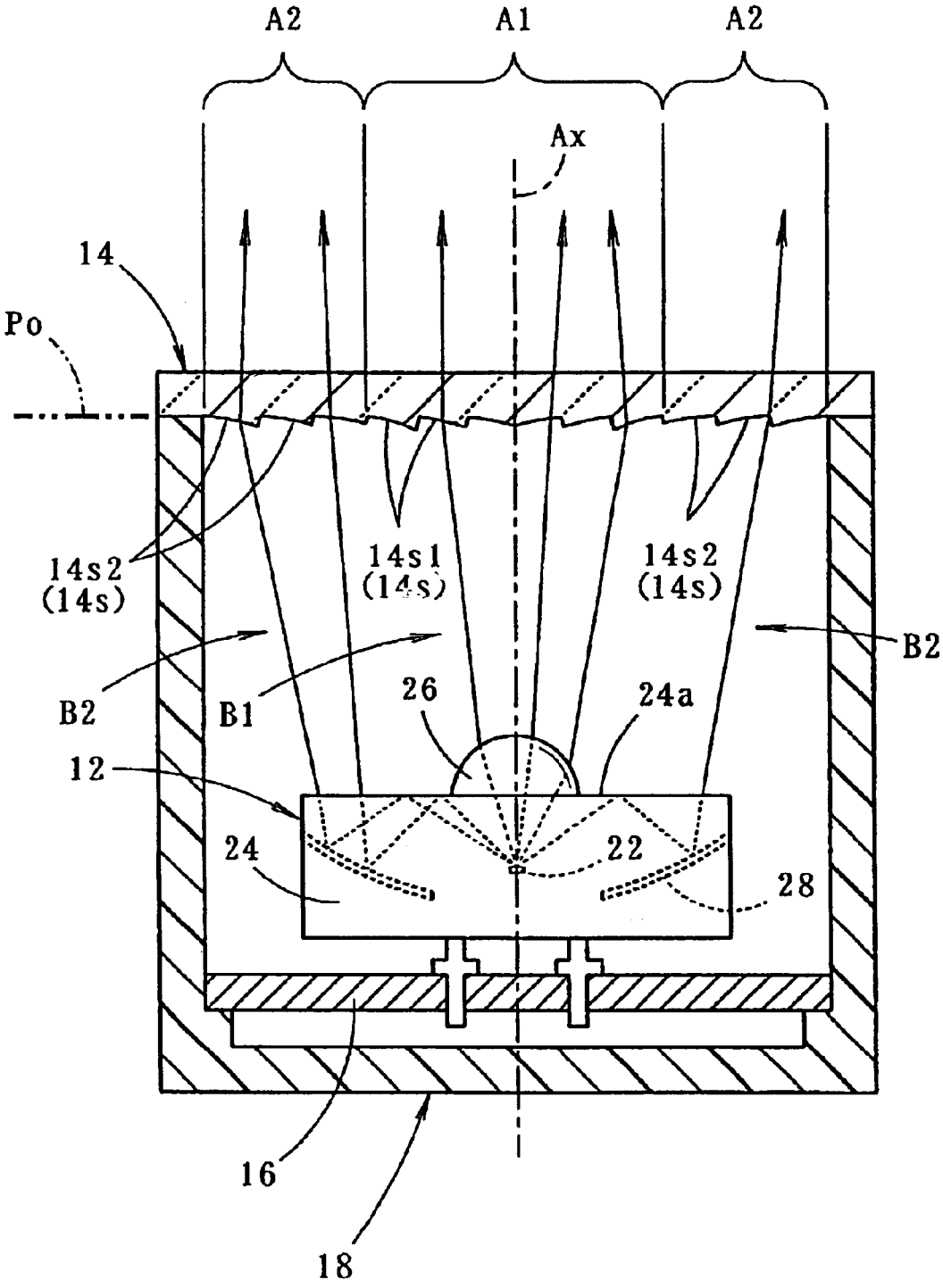
FIG. 2 is a sectional view taken long the line 2—2 in FIG. 1, illustrating the vehicle lamp.

The special LED 12 is a custom LED assembly that is comprised of a translucent block body 24, an LED chip 22 embedded in the translucent block body 24, a condenser lens 26 protruded in a substantially semi-spherical shape on the front end surface 24*a* of the translucent block body 24 so as to be located in front of the LED chip 22, and a reflector 28 that reflects the light that is from the LED chip 22 and is, as best seen from FIG. 2, reflected (internally reflected) from the portion of the front end surface 24*a* of the translucent block body 24 that is located around the condenser lens 26.

The special LED 12 has a substantially rectangular shape that is elongated in a lateral (horizontal) direction in the front view of the lamp (see FIG. 1) and is disposed so that the LED chip 22 is positioned on a lamp optical axis Ax that extends in a front-back direction (or in the direction of the depth) of the lamp (see FIG. 2).

The light which is from the LED chip 22 and is incident upon the condenser lens 26 is refracted toward the lamp optical axis Ax. Accordingly, the direct light B1 passing through the condenser lens 26 forms a bundle of diffuse rays expanding in a conical shape about the lamp optical axis Ax. On the other hand, the reflection light B2 from the reflector 28 forms a ring-shaped bundle of diffuse rays expanding about a conical plane with the lamp optical axis Ax being a center axis. The direct light B1 forms a bundle of rays with higher light intensity than the reflection light B2.

Figure 7:
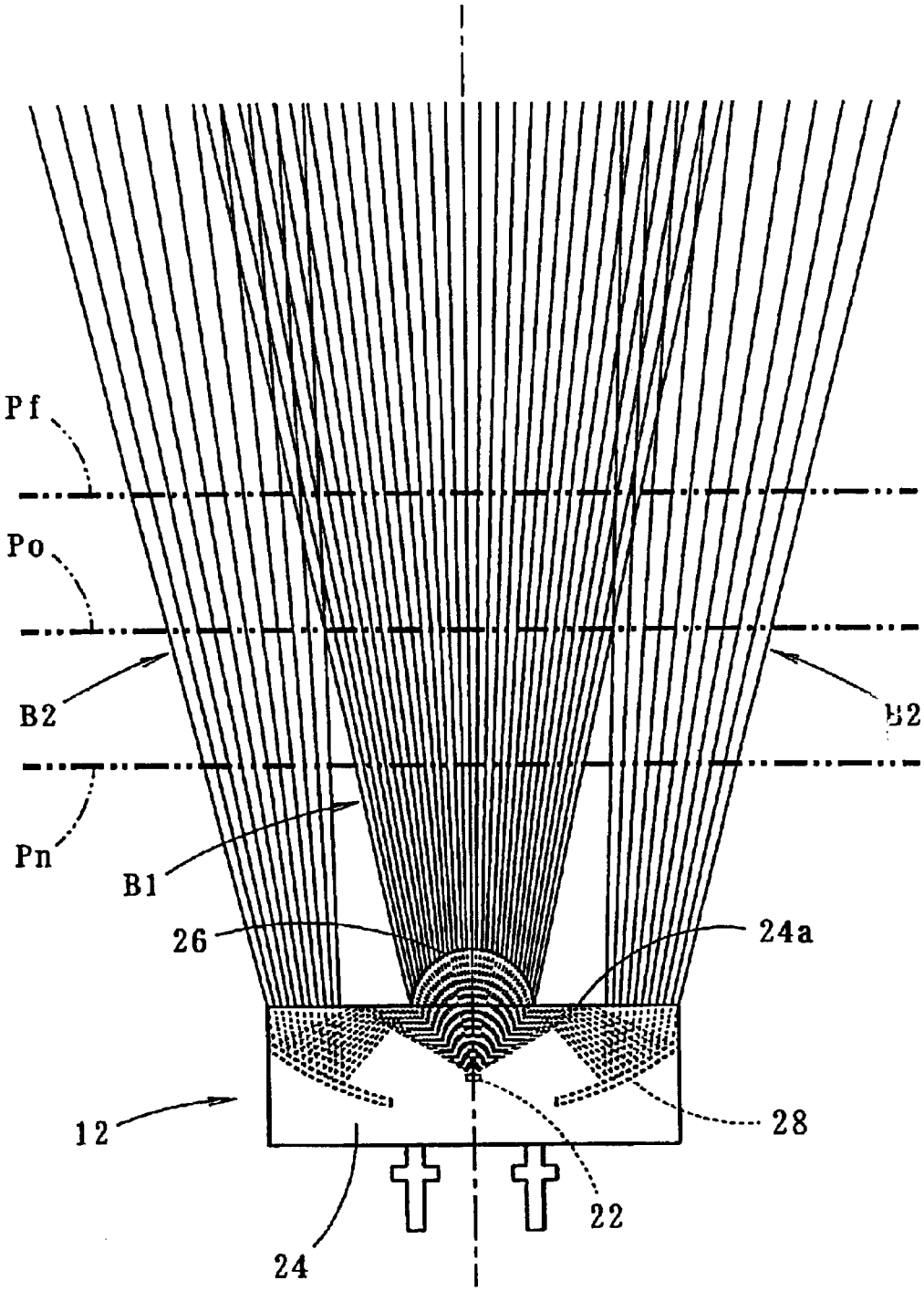
FIG. 7 shows a single special LED used in the embodiment of the present invention.
Figure 8:
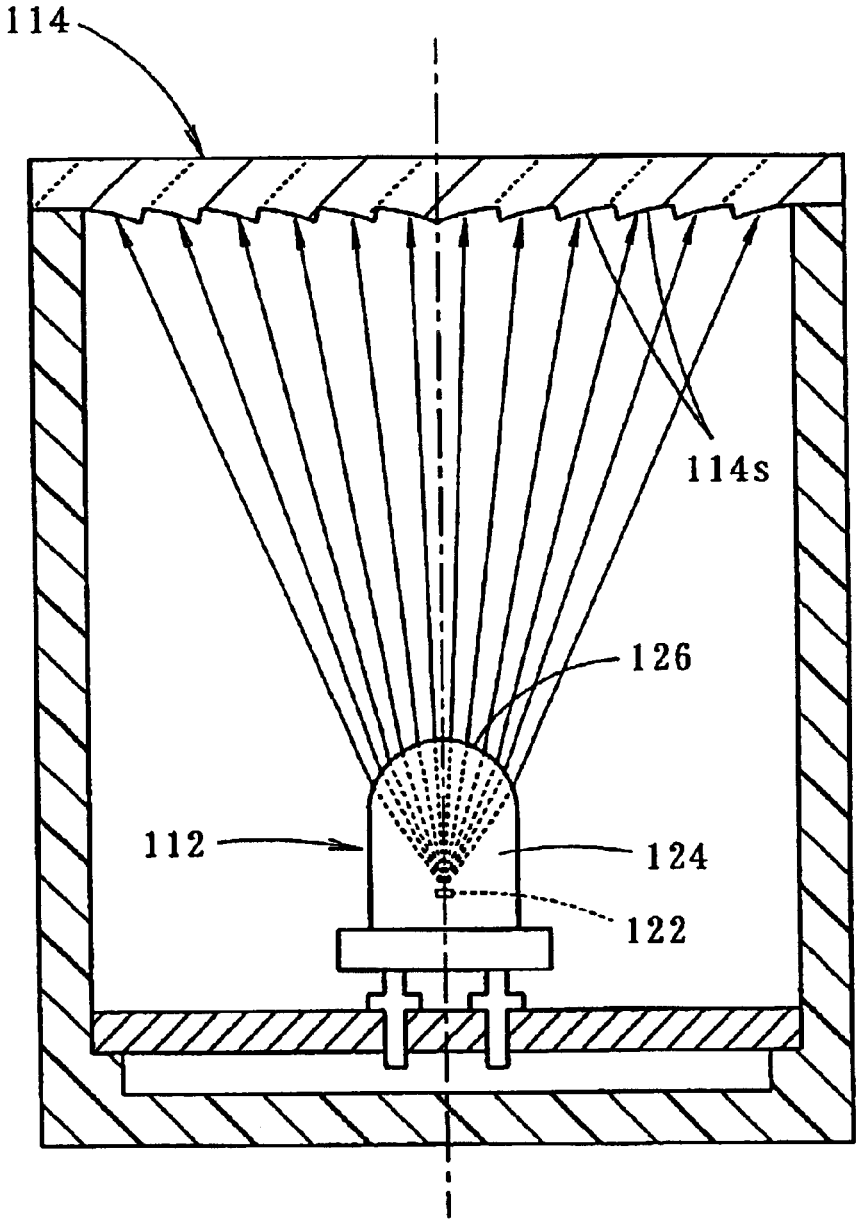
FIG. 8 PRIOR ART
FIG. 8 shows in cross section a conventional vehicle lamp that uses an LED.

The direct light B1 and the reflection light B2 start to intersect with each other at a position Po (see also FIG. 7) that is at a predetermined distance in front of the front end surface 24*a* of the translucent block body 24.

Figure 3:
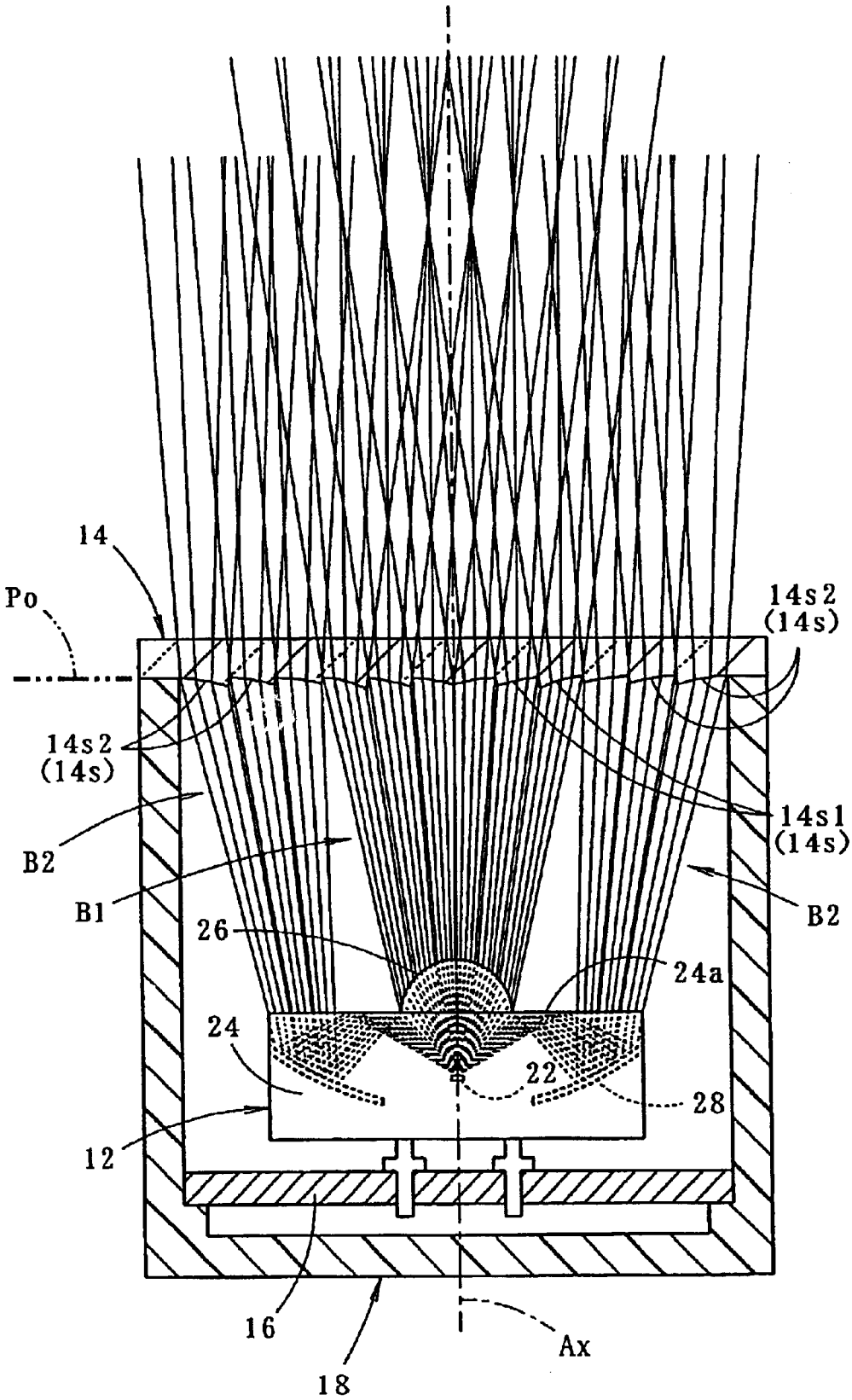
FIG. 3 shows the detail of the light path in the structure of FIG. 2.
Figure 4:
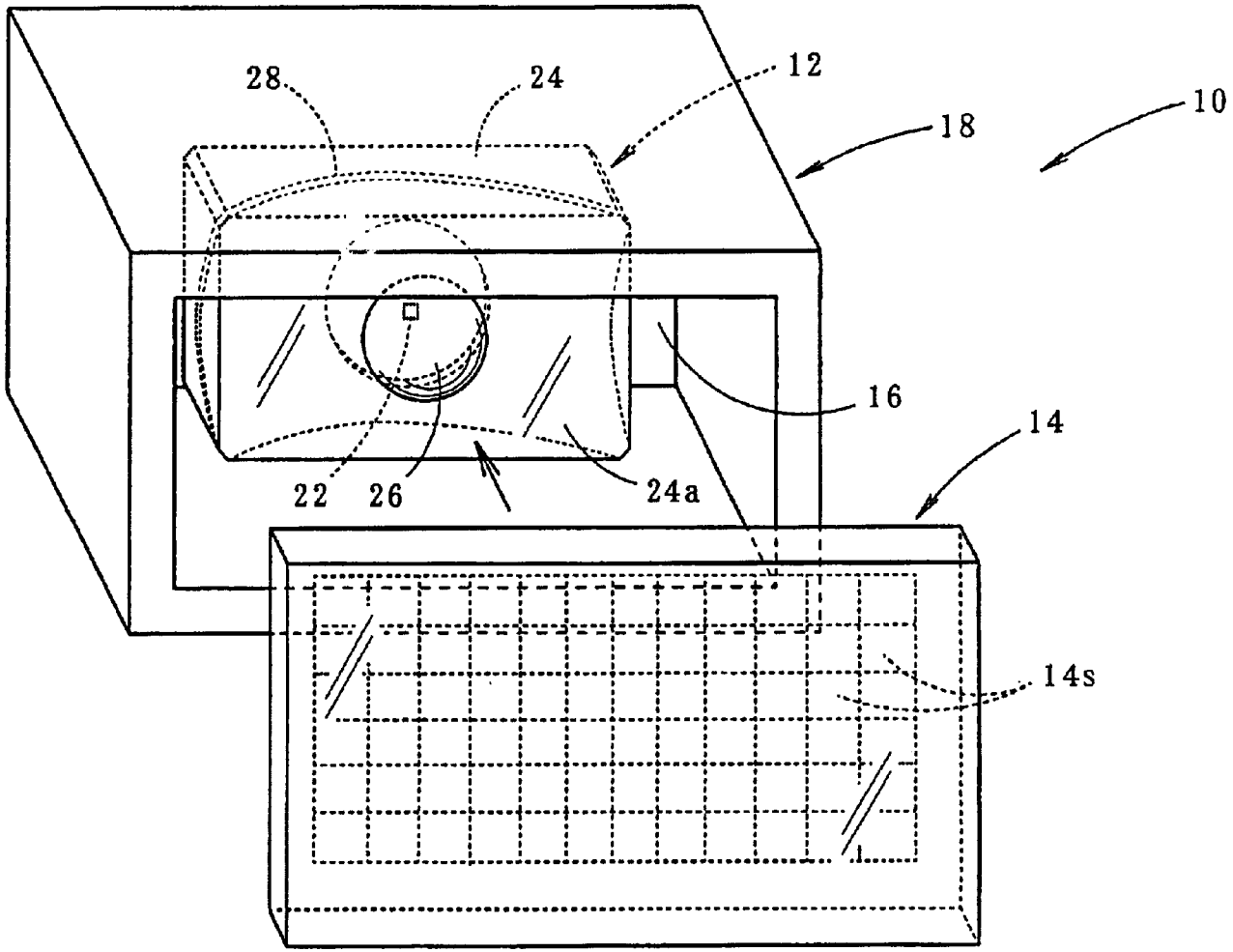
FIG. 4 is an exploded perspective view of the vehicle lamp of the present invention.

The front lens 14 is, as best seen from FIGS. 2 and 3, disposed near the position Po at which the direct light B1 and the reflection light B2 start to intersect with each other. A plurality of lens elements 14*s* that are formed on the front lens 14 are disposed in a grid pattern on the rear surface of the front lens 14. The lens elements 14*s* diffuse and deflect the light from the special LED 12 toward the lamp optical axis Ax.

Of the lens elements 14*s*, lens elements 14*s*1 located in an direct light impinging area A1 where the direct light B1 impinges has a diffusion angle that is set at a greater value than the diffusion angle of lens elements 14*s*2 located in a reflection light impinging area A2 where the reflection light B2 impinges. For example, the diffusion angle of the lens elements 14*s*1 is set at 8° in the upward, downward, left and right directions from an axis parallel to the lamp optical axis Ax, and the diffusion angle of the lens elements 14*s*2 is set at 3° in the upward, downward, left and right directions from an axis parallel to the lamp optical axis Ax.

Figure 5:
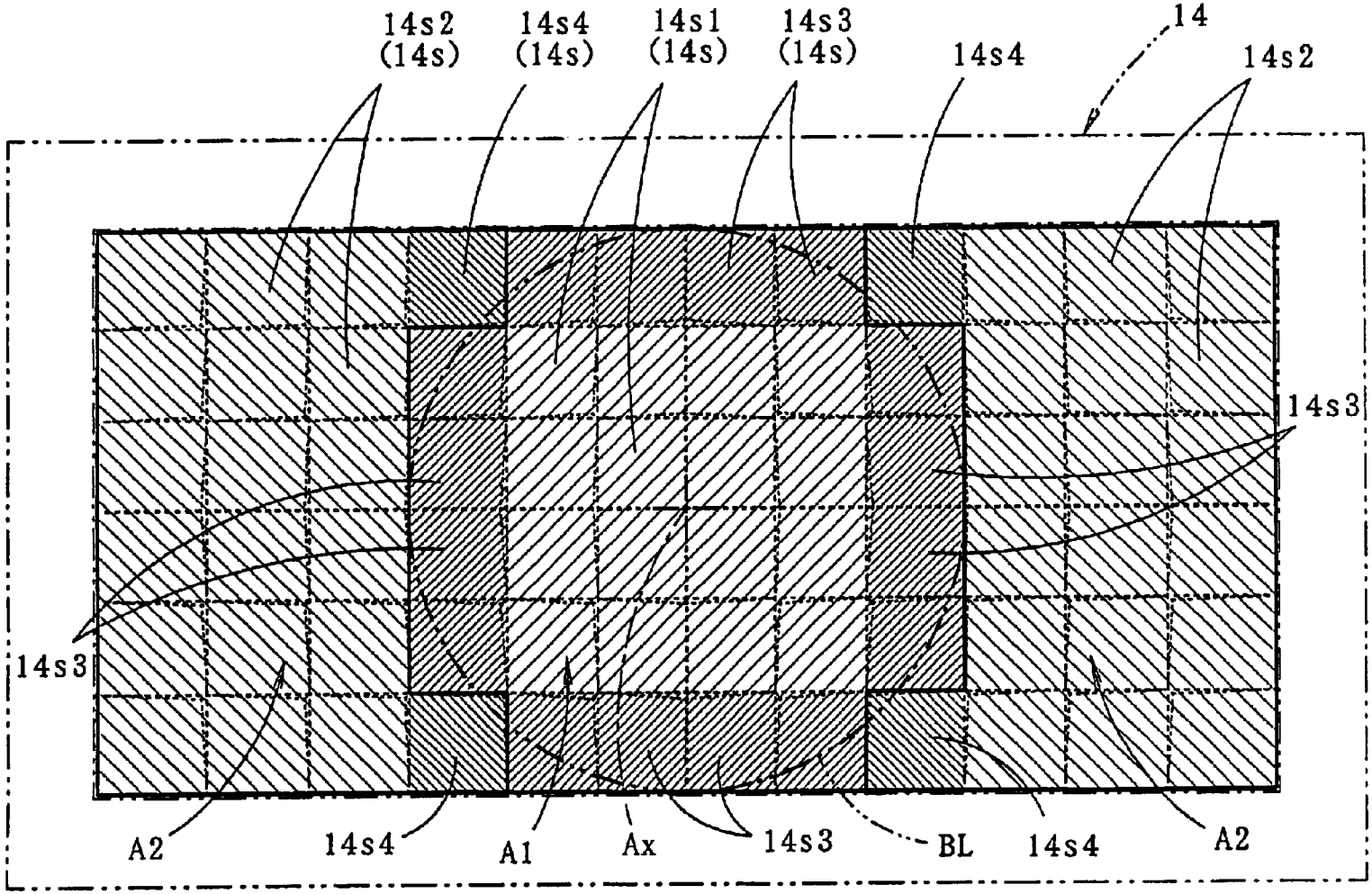
FIG. 5 is a front view of a plurality of lens elements that make a front lens of the vehicle lamp of the present invention.

As seen from FIG. 5, a plurality of lens elements 14*s* are formed on the front lens 14.

The borderline BL between the direct light impinging area A1 and the reflection light impinging area A2 appears in a substantially circular shape on the front lens 14. Accordingly, some lens elements such as those referred to as the reference numerals 14*s*3 and 14*s*4 are located on the borderline BL. Accordingly, the diffusion angle of each of the lens elements 14*s*3 and 14*s*4 is set at a diffusion angle set for the lens element of the areas that correspond to either one of the direct light B1 and the reflection light B2 that is incident in a greater amount. More specifically, the lens elements 14*s*3 where the direct light B1 impinges in greater amounts than the reflection light B2 has a diffusion angle that is equal to the diffusion angle of the lens elements 14*s* 1 located in the direct light impinging area A1. The lens elements 14*s*4 where the reflection light B2 impinges in greater amounts has a diffusion angle that is equal to the diffusion angle of the lens elements 14*s*2 located in the reflection light impinging area A2.

As described above, the vehicle lamp 10 in the shown embodiment employs the special LED 12 as the light source; and the light radiating from the LED chip 22 of the special LED 12 in directions within a predetermined range of angle with respect to the forward direction relative to the LED chip 22 is used by way of refracting the light toward the forward direction by the condenser lens 26 of the special LED 12. Furthermore, the light radiating at great radiation angles with respect to the forward direction can also be utilized as a reflection light from the reflector 28 of the special LED 12.

Therefore, the radiation light from the LED chip 22 is used efficiently, and the light having an increased intensity is emitted. It becomes thus possible to sufficiently provide an illumination light intensity required for a vehicle.

In the vehicle lamp 10 of the shown embodiment, the light from the special LED 12 is subjected to a diffusion deflection control by a plurality of lens elements 14*s* formed on the front lens 14 that is provided in front of the special LED 12. Since the front lens 14 is disposed near the position Po where the direct light B1 passing through the condenser lens 26 and the reflection light B2 from the reflector 28 start to intersect with each other, the lamp has various advantages.

More specifically, though the direct light B1 and the reflection light B2 differ from each other in the direction of incidence and the intensity of light, since the front lens 14 is disposed near the position Po at which the direct light B1 and the reflection light B2 start to intersect with each other, the formation of an overlapped incidence area in the front lens where the overlap between the direct light B1 and the reflection light B2 is incident is avoided. Accordingly, it becomes possible to appropriately perform the diffusion deflection control on the light from the special LED 12 by the front lens 14.

Furthermore, since the front lens 14 is disposed near the position Po where the direct light B1 and the reflection light B2 start to intersect with each other, it is possible to prevent the formation of a no-light impinging area in the front lens 14 where no light from the special LED 12 is incident. Thus, the front lens 14 appears bright over the entire surface thereof when the lamp is on, and appearance degradation of the lamp is prevented.

Thus, according to the embodiment above, it is possible to appropriately perform the diffusion deflection control on the light from the special LED 12 by means of the front lens 14 without causing any degradation in the appearance of the lamp.

As described above, the direct light B1 has a higher light intensity than the reflection light B2. In the embodiment, however, of the plurality of lens elements 14*s* that are formed on the front lens 14, the lens elements 14*s*1 positioned in the direct light impinging area A1 has a diffusion angle that is set at a value which is greater than the diffusion angle of the lens elements 14*s*2 located in the reflection light impinging area A2. Accordingly, the entire front lens 14 appears substantially uniformly bright when the lamp is on, and thus the appearance of the lamp is enhanced.

In the above embodiment furthermore, the plurality of lens elements 14*s* that are formed on the front lens 14 are arranged in a grid pattern. As for the lens elements 14*s*3 and 14*s*4 that are positioned on the borderline B1 between the direct light impinging area A1 and the reflection light impinging area A2 that is formed in a substantially circular shape on the front lens 14, the diffusion angle of each one of the lens elements 14*s*3 and 14*s*4 is set at a diffusion angle which is set for the lens elements disposed in the areas where either one of the direct light B1 and the reflection light B2 impinges in a greater amount. Accordingly, it becomes possible to perform sufficiently appropriate diffusion deflection control.

Modifications of the foregoing embodiment will be next described below with reference to FIGS. 6(*a*) through 6(*c*).

In the vehicle lamp 10 of the foregoing embodiment, a single special LED 12 is provided as a light source. In the vehicle lamp 50 in this modification, a plurality (five) of special LEDs 12 are provided.

More specifically, the special LEDs 12 are disposed linearly on one line at equal intervals in a lateral (horizontal) direction and are supported on a common printed circuit board 56. The special LEDs 12 are disposed so that the irradiation directions are aligned to the same direction. Each special LED 12 is disposed so that the special LED 12 is long in the lateral direction as in the foregoing embodiment.

The printed circuit board 56 is, together with the special LEDs 12, supported by a lamp body 58. A front lens 54 is provided on the front end surface of the lamp body 58.

The front lens 54 has a plurality of lens elements 54*s* that are disposed so as to correspond to the individual special LEDs 12 for diffusion deflection control of the light from the special LEDs 12. The lens elements 54*s*1, 54*s*2, 54*s*3 and 54*s*4 that respectively correspond to the lens elements 14*s*1, 14*s*2, 14*s*3 and 14*s*4 of the foregoing embodiment are provided for each special LED 12.

With the above structure in which a plural number of special LEDs 12 are disposed in the vehicle lamp 50, the front lens 54 appear bright for a broad luminescent area.

Figures 6A, 6B, 6C:
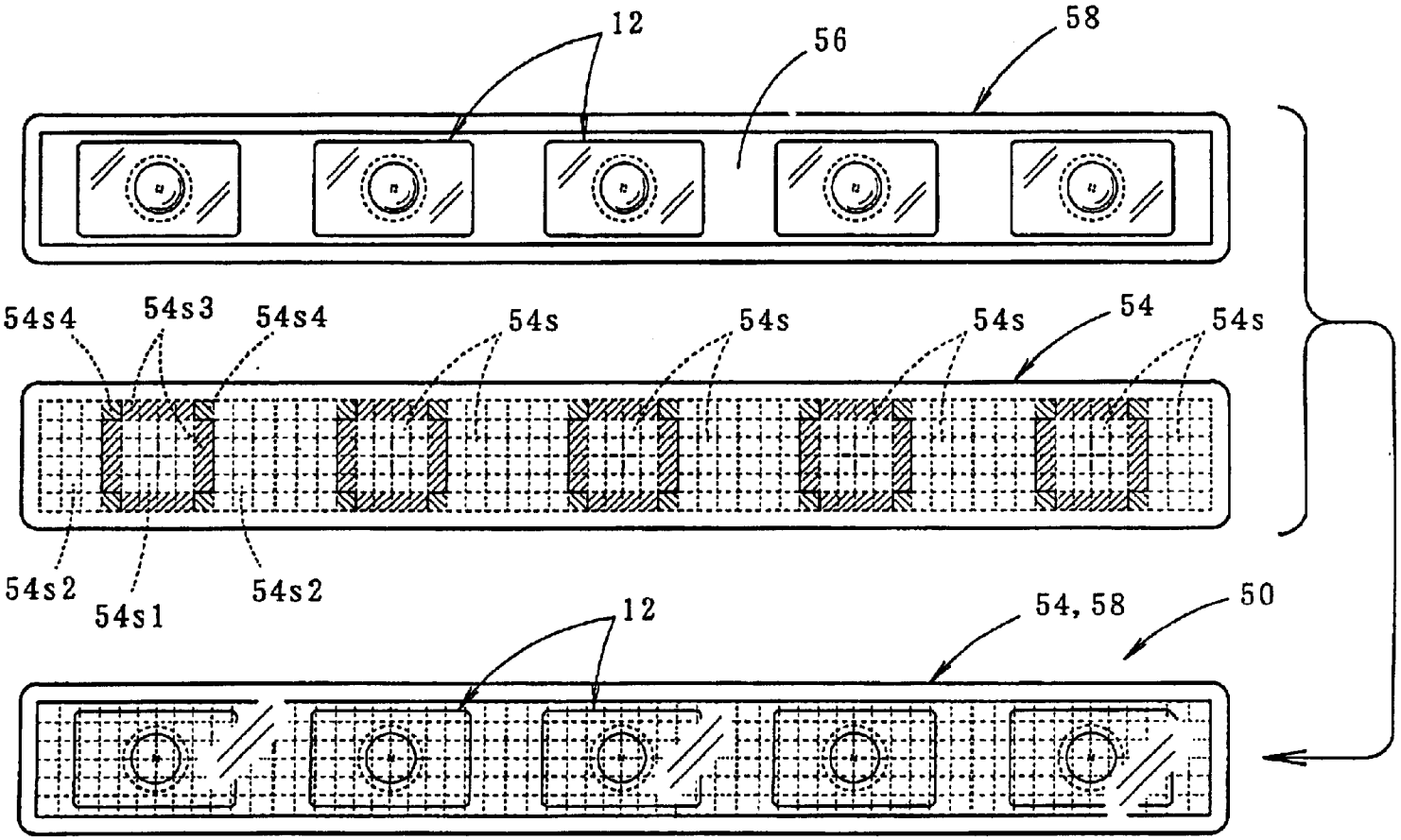
FIG. 6(*a*) is a front view of a lamp body with five special LEDs mounted thereon, FIG. 6(*b*) is a front view of a front lens therefor, and FIG. 6(*c*) is a front view in which the lamp body and the front lens are assembled into a vehicle lamp.

In the vehicle lamp 50 shown in FIGS. 6(*a*) through 6(*c*), the special LEDs 12 are disposed linearly on one line at equal intervals in the lateral (horizontal) direction, and each special LED 12 had a substantially rectangular shape that is elongated in the lateral direction. Accordingly, this structure is applicable to a thin-type lamp suited for a high-mount stop lamp or the like.

Instead of the arrangement of the special LEDs 12 in a linear fashion in one row as in the foregoing modification, a plurality of special LEDs 12 can be disposed linearly in a plurality of rows. Furthermore, a plurality of special LEDs 12 can be disposed in one or more rows in an arc or wave shape.

What is claimed is:

1. A vehicle lamp comprising a special LED, which is a light source, and a front lens, which is provided in front of the special LED and performs a diffusion deflection control of light from the special LED by a plurality of lens elements formed on the front lens, wherein the special LED comprises:

a translucent block body, an LED chip embedded in the translucent block body, a condenser lens protruded in a substantially semi-spherical shape on a front end surface of the translucent block body and positioned in front of the LED chip, and a reflector provided inside the translucent block body and forwardly reflects light that is originated from the LED chip and reflected by a portion of the front end surface of the translucent block body that is a peripheral area of the condenser lens, and wherein the front lens is disposed near a position where direct light passing through the condenser lens and reflection light from the reflector start to intersect with each other.

2. The vehicle lamp according to claim 1, wherein of the plurality of lens elements formed on the front lens, a lens element positioned in a direct light impinging area where the direct light impinges has a diffusion angle that is set at a value which is greater than a diffusion angle of a lens element positioned in a reflection light impinging area where the reflection light impinges.

3. The vehicle lamp according to claim 2, wherein:

the plurality of lens elements are disposed in a grid pattern, and the diffusion angle of a lens element positioned on a borderline between the direct light impinging area and the reflection light impinging area is set at a diffusion angle that is set for a lens element which is set for a greater impinging amount between the direct light and the reflection light.

4. The vehicle lamp according to claim 3, wherein:

a plurality of special LEDs are disposed in a manner that the special LEDs have an aligned irradiation direction, and the front lens is formed with a plurality of lens elements that perform a diffusion deflection control of light from the special LEDs for each one of the special LEDs.

5. The vehicle lamp according to claim 4, wherein a plurality of special LEDs are disposed in a row, and each of the special LEDs has a substantially rectangular shape that is elongated in a direction of the row arrangement of the LEDs.

6. The vehicle lamp according to claim 1, wherein:

a plurality of special LEDs are disposed in a manner that the special LEDs have an aligned irradiation direction, and the front lens is formed with a plurality of lens elements that perform a diffusion deflection control of light from the special LEDs for each one of the special LEDs.

7. The vehicle lamp according to claim 6, wherein a plurality of special LEDs are disposed in a row, and each of the special LEDs has a substantially rectangular shape that is elongated in a direction of the row arrangement of the LEDs.

8. The vehicle lamp according to claim 2, wherein:

a plurality of special LEDs are disposed in a manner that the special LEDs have an aligned irradiation direction, and the front lens is formed with a plurality of lens elements that perform a diffusion deflection control of light from the special LEDs for each one of the special LEDs.

9. The vehicle lamp according to claim 8, wherein a plurality of special LEDs are disposed in a row, and each of the special LEDs has a substantially rectangular shape that is elongated in a direction of the row arrangement of the LEDs.

* * * * *